US008333220B2

(12) United States Patent
King

(10) Patent No.: US 8,333,220 B2
(45) Date of Patent: Dec. 18, 2012

(54) DOUBLE LAYER WOVEN FABRIC

(75) Inventor: Kevin Nelson King, Alto, GA (US)

(73) Assignee: Nicolon Corporation, Pendergrass, GA (US)

( * ) Notice: Subject to any disclaimer, the term of this patent is extended or adjusted under 35 U.S.C. 154(b) by 1196 days.

(21) Appl. No.: 11/586,839

(22) Filed: Oct. 26, 2006

(65) Prior Publication Data

US 2007/0277897 A1 Dec. 6, 2007

Related U.S. Application Data

(60) Provisional application No. 60/809,875, filed on Jun. 1, 2006.

(51) Int. Cl.
*D03D 3/04* (2006.01)
*D21F 1/10* (2006.01)
*D03D 25/00* (2006.01)

(52) U.S. Cl. ..... 139/383 A; 139/408; 139/413; 139/420 R; 139/426 R; 139/420 A

(58) Field of Classification Search ..... 139/383 R, 139/408, 413, 420 R, 426 R, 420 A
See application file for complete search history.

(56) References Cited

U.S. PATENT DOCUMENTS 3,405,410 A * 10/1968 Oldshue ..... 4/498
3,593,757 A * 7/1971 Haynes ..... 139/383 R
3,872,522 A * 3/1975 Bennett et al. ..... 4/498
4,028,750 A * 6/1977 Gustafsson ..... 4/498
4,137,575 A * 2/1979 Klaffke et al. ..... 4/498
4,173,043 A * 11/1979 Vernon ..... 4/502
4,663,231 A * 5/1987 Girgis et al. ..... 428/378
4,815,499 A * 3/1989 Johnson ..... 139/383 A
5,511,536 A * 4/1996 Bussey et al. ..... 126/565
5,651,641 A 7/1997 Stephens et al.
5,769,131 A * 6/1998 Whitlock et al. ..... 139/383 AA
5,795,516 A * 8/1998 Cho et al. ..... 264/103
5,819,811 A * 10/1998 Baker et al. ..... 139/383 AA
5,837,133 A 11/1998 Natale
5,887,296 A * 3/1999 Handwerker ..... 4/498
5,922,421 A * 7/1999 Perry ..... 428/34.1
6,047,415 A * 4/2000 Brown ..... 4/498
6,179,013 B1 * 1/2001 Gulya ..... 139/383 A
6,186,701 B1 2/2001 Kempers
6,418,974 B1 * 7/2002 King ..... 139/383 R
6,766,542 B2 * 7/2004 Hinsperger ..... 4/498
6,836,907 B1 * 1/2005 Pesta ..... 4/498
6,886,187 B2 * 5/2005 Zell et al. ..... 4/498
6,915,534 B1 * 7/2005 Johannes ..... 4/498
7,059,360 B1 * 6/2006 Majaury et al. ..... 139/383 A
7,259,113 B2 * 8/2007 Dufresne-Nappert et al. ... 442/2
2004/0117903 A1 * 6/2004 Hinsperger ..... 4/498
(Continued)

FOREIGN PATENT DOCUMENTS

EP 0269070 6/1988

*Primary Examiner* — Bobby Muromoto, Jr.
(74) *Attorney, Agent, or Firm* — Cantor Colburn LLP

(57) ABSTRACT

A double layer woven fabric for use in various applications, including recreational applications such as pool covers. The fabric is formed by two layers of yarns secured together. At least one layer (and, in one embodiment, both layers) of yarns comprises at least two types of yarn of differing geometrical shapes that are preferably positioned alternately across the fabric. The yarns of one shape help to block sunlight while the yarns of the other shape help to ensure that open channels are formed through the fabric for water flow.

35 Claims, 1 Drawing Sheet

U.S. PATENT DOCUMENTS

2004/0127129 A1* 7/2004 Luo et al. ..... 442/362
2004/0177435 A1* 9/2004 Zell et al. ..... 4/498
2005/0022297 A1* 2/2005 Orologio et al. ..... 4/498
2005/0055760 A1* 3/2005 Sutton et al. ..... 4/498
2005/0125887 A1 6/2005 Taylor
2005/0239354 A1* 10/2005 Dufresne-Nappert et al. ... 442/2
2005/0241056 A1* 11/2005 Zell et al. ..... 4/498
2006/0166577 A1* 7/2006 Rashed ..... 442/1

* cited by examiner

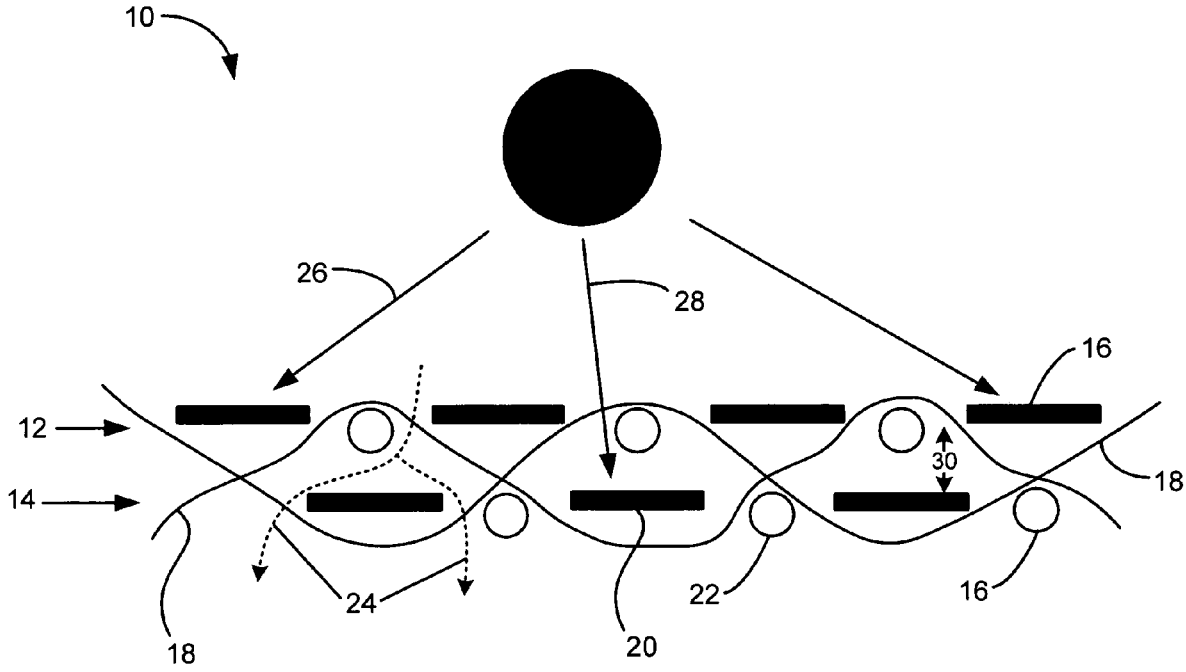
10
26
28
16
12
14
30
18
24
22
16
18
20

DOUBLE LAYER WOVEN FABRIC

CROSS REFERENCE TO RELATED APPLICATIONS

This application claims the benefit of U.S. Provisional Application No. 60/809,875 filed Jun. 1, 2006, the contents of which are incorporated herein by reference.

FIELD OF THE INVENTION

The invention relates to a double layer woven fabric having enhanced water flow and shade properties.

BACKGROUND OF THE INVENTION

Outdoor pools are often covered with a safety pool cover during the winter months when they go unused. Covering a pool obviates the need to maintain the pool during the winter and protects the pool from the harsh conditions of winter. In use, safety pool covers prevent debris and other foreign objects from entering the pool water and have the necessary strength to prevent a person from falling into the pool.

To prevent algae growth in the pool when covered, it is preferable that pool covers be made from a fabric that prevents as much sunlight as possible from penetrating through the pool cover fabric and into the water below. Traditional pool covers were made from a woven fabric that was coated with a plastic material, such as polyvinylchloride. The resulting fabric was UV resistant to block sunlight and thereby prevent algae growth under the pool cover. However, the cover was also solid in that it was impermeable to fluid and moisture. Mechanical drains were incorporated into the covers else, when it rained, water would collect on top of the cover and the pool cover would tend to sag under the weight of the collected water. However, the drains oftentimes would clog with debris, rendering them ineffective for drainage purposes.

To combat these problems, pool covers began being made from single-layer, woven, uncoated fabrics. These fabrics allowed water to flow through the apertures in the cover and thus prevented water collection on top of the cover. However, because these fabrics were not solid, just as water was allowed to pass through the fabric so too was sunlight. Thus, these fabrics were less capable of blocking sunlight and preventing algae growth.

Traditionally, the more water flow the pool cover allowed (i.e., the more apertures that are provided in the fabric or the larger the size of the apertures provided in the fabric), the less capable the pool cover was at blocking light and thus preventing algae growth. For example, U.S. Pat. No. 6,886,187 to Zell et al. discloses a pool cover made from a single-layer woven fabric that purportedly blocks 100% sunlight. Yet the disclosed fabric provides a flow rate of water of only 0.1 to 5 gallons per square foot per minute. There remains a need for a woven fabric for pool covers that successfully blocks sunlight (preferably up to 100%) and provides for higher water flow through the pool cover.

SUMMARY OF THE INVENTION

This invention relates generally to a double layer woven fabric for use in various applications including but not limited to: recreational applications such as, but not limited to, trampolines, sports fields and pool covers; horticultural applications such as, but not limited to, shade use for nurseries, greenhouses, and livestock; industrial applications such as, but not limited to, truck covers, fencing, windscreen containment enclosures, sand blasting, weed control, and industrial debris mats; construction applications such as, but not limited to, filtration, drainage, erosion control, soil reinforcement, secondary reinforcement, paving, soil stabilization, soil separation, earth retaining structures, steepened slopes, embankment stabilization, leachate collection/removal, dewatering bags, and Geotubes® (such as disclosed in U.S. Pat. No. 6,186,701); and agricultural applications. The fabric is particularly well-suited for use as a pool cover, although in no way do the applicants intend for the fabric disclosed herein to be limited to this use only.

One embodiment of the fabric is formed by two layers of fill yarns that are secured together with warp yarns. The fill yarns within at least one layer (and preferably but not necessarily in both layers) have at least two different geometrical shapes. The yarns of one shape help to block sunlight while the yarns of the other shape help to ensure that open channels are formed through the fabric for water flow. Moreover, to the extent that the upper layer of yarns fails to deflect light, the second layer of yarns serves as a back-up layer to help ensure blockage of light. In this way, the fabric provides the desired high shade (preferably blocking at least approximately 99% of light) while allowing high water to flow through the fabric (i.e., between 5-75 gallons per square foot per minute).

BRIEF DESCRIPTION OF THE DRAWINGS

FIG. 1 is a cross-sectional view of one embodiment of the fabric of this invention.

DETAILED DESCRIPTION OF THE DRAWINGS

FIG. 1 illustrates one embodiment of the fabric of this invention. The fabric 10 includes two weft systems or layers 12, 14 of weft or fill yarns 16 that are woven together with a warp system having warp yarn 18. Note, however, that layers 12, 14 could be oriented in the warp direction and yarn 18 could be oriented in the weft direction. At least one layer 12, 14 of yarns 16 (and, in the embodiment disclosed in FIG. 1, both layers 12, 14 of yarns 16) comprises two types of yarn 20, 22 of differing geometrical shapes that are preferably positioned alternately across the fabric. As shown in FIG. 1, the first yarn 20 is preferably but not necessarily a tape yarn in that has a rectilinear cross-section with a width greater than its thickness. One thousand (1000) denier to 2900 denier fibrillated tape is particularly useful in this application, with 1500 denier fibrillated tape being the most preferable. The second yarn 22 is preferably but not necessarily a monofilament yarn having a different geometrically-shaped cross-section than first yarn 20. In this embodiment, second yarn 22 has a substantially rounded cross-sectional shape, such as a substantially circular cross-sectional shape shown in FIG. 1. However, as explained in more detail below, second yarn 22 can be of any shape that prevents the two layers 12, 14 from lying directly adjacent to each other along their entire lengths but rather ensures that a gap 30 is maintained between the two layers 12, 14 at least at certain points along the fabric length. Four hundred (400) denier to 1600 denier monofilament yarn is preferable for the second yarn 22.

Moreover, as shown in FIG. 1, the first and second yarns 20, 22 in layer 12 are preferably offset from the first and second yarns 20, 22 in layer 14 so that, when layers 12, 14 are woven together, a first yarn 20 in layer 12 is primarily adjacent to a second yarn 22 in layer 14.

The two layers 12, 14 are preferably woven together with yarn 18. The yarn 18 is preferably, but does not have to be, 400 denier to 1500 denier monofilament yarn. All of the yarns used in fabric 10 are preferably, but do not have to be, made from synthetic polymers and more preferably from polypropylene. While the density of the fabric will depend on its intended properties and uses, the fabric in the warp direction preferably has a density of 20 to 50 threads/inch, and the fabric in the fill or weft direction preferably has a density of 15 to 40 threads/inch.

The resulting fabric 10 may be, but does not have to be, subjected to a calendaring process whereby the fabric 10 is subjected to heat and pressure (such as by running the fabric through a set of heated rollers) to compress and/or flatten yarns 16, 18 and thereby reduce the overall thickness of fabric 10.

The double layer structure of fabric 10 forms essentially a solid sheet of fibers that prevent at least, and preferably more than, 99% of light from passing through the fabric 10 while providing open channels 24 through the fabric 10 for water flow. Any test that accurately measures the amount of light transmitted through fabric 10 may be employed to determine light penetration and resulting shade percentage. For example, a shade box provided with a light source at one end and a light meter at the other end may be used. The fabric to be tested is positioned between the light source and meter, the light source is activated, and the light meter measures the amount of light (R) that penetrates through the fabric and reaches the meter. The amount of shade that the fabric affords can then be calculated based on that measurement (% Shade=100−R). U.S. Pat. No. 5,651,641, the entirety of which is herein incorporated by reference, discloses detailed specifications for measuring light penetration.

As illustrated in FIG. 1, sun rays 26, 28 travel in substantially straight lines. The wider tape yarns 20 provided on the fabric 10 deflect the sun rays. To the extent that a sun ray 28 is not deflected by a tape yarn 20 in the upper layer 12 of the fabric 10 (such as sun ray 28), then a tape yarn 20 in the lower layer 14 of the fabric 10 will deflect the ray 28 and thereby prevent light from penetrating through the fabric 10 to the water underneath.

Moreover, the different geometrical shapes of the yarns 20, 22 forming the fabric 10 create open channels 24 for water to flow through the fabric 10. More specifically, the substantially circular shape and size of second yarns 22 ensure that a gap 30 is maintained between the two layers 12, 14. Open channels 24 through which water can flow extend between adjacent yarns 16 in each layer 12, 14 and through the gap 30 between the layers 12, 14. With this double layer fabric construction, water is able to flow at a rate between 5-75 gallons per square foot per minute through the fabric 10, as measured by ASTM standard D4491-99A.

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims.

I claim:

1. A fabric comprising:

a first weft system of weft yarns woven to a second weft system of weft yarns, wherein at least a portion of the first weft system comprises a plurality of first weft yarns and a plurality of second weft yarns, each of the first and second weft yarns having a cross-sectional shape, wherein the cross-sectional shape of the first weft yarns of the first weft system is different from the cross-sectional shape of the second weft yarns of the first weft system, at least some of the weft yarns of the first weft system being substantially vertically stacked with weft yarns of the second weft system, and the cross-sectional shapes of the respectively stacked weft yarns of the first and second weft systems being different from one another.

2. The fabric of claim 1, wherein channels extend through the fabric between the first and second weft systems.

3. The fabric of claim 2, wherein water is capable of flowing through the channels of the fabric at a rate between five to seventy-five gallons per square foot per minute.

4. The fabric of claim 1, wherein the fabric prevents at least approximately 99% of light from passing through the fabric.

5. The fabric of claim 1, wherein the first weft yarns and the second weft yarns of the first weft system alternate across a width of the fabric.

6. The fabric of claim 1, wherein the cross-sectional shape of the first weft yarns of the first weft system is substantially rectilinear.

7. The fabric of claim 6, wherein the first weft yarns of the first weft system comprise fibrillated tape.

8. The fabric of claim 1, wherein the cross-sectional shape of the second weft yarns of the first weft system is substantially rounded.

9. The fabric of claim 8, wherein the cross-sectional shape of the second weft yarns of the first weft system is substantially circular.

10. The fabric of claim 1, wherein the second weft system of weft yarns comprises a plurality of first weft yarns and a plurality of second weft yarns, each of the first and second weft yarns of the second weft system having a cross-sectional shape, wherein the cross-sectional shape of the first weft yarns of the second weft system is different from the cross-sectional shape of the second weft yarns of the second weft system.

11. The fabric of claim 10, wherein the first weft yarns and the second weft yarns of the second weft system alternate across a width of the fabric.

12. The fabric of claim 10, wherein the cross-sectional shape of the first weft yarns of the second weft system is substantially rectilinear.

13. The fabric of claim 12, wherein the first weft yarns of the second weft system comprise fibrillated tape.

14. The fabric of claim 10, wherein the cross-sectional shape of the second weft yarns of the second weft system is substantially rounded.

15. The fabric of claim 14, wherein the cross-sectional shape of the second weft yarns of the second weft system is substantially circular.

16. The fabric of claim 10, wherein:

the cross-sectional shape of the first weft yarns of the first and second weft systems is substantially rectilinear;

the cross-sectional shape of the second weft yarns of the first and second weft systems is substantially rounded;

the first and second weft yarns of the first weft system alternate across a width of the fabric; and the first and second weft yarns of the second weft system alternate across the width of the fabric.

17. The fabric of claim 16, wherein at least some of the first weft yarns of the first weft system are substantially adjacent to at least some of the second weft yarns of the second weft system.

18. The fabric of claim 16, wherein at least some of the second weft yarns of the first weft system are substantially adjacent to at least some of the first weft yarns of the second weft system.

19. A pool cover comprising the fabric of claim 1.

20. A fabric comprising a first weft system of weft yarns woven to a second weft system of weft yarns, wherein:

the first weft system comprises a plurality of first weft yarns and a plurality of second weft yarns, each of the first and second weft yarns of the first weft system having a cross-sectional shape;

the second weft system comprises a plurality of first weft yarns and a plurality of second weft yarns, each of the first and second weft yarns of the second weft system having a cross-sectional shape;

the cross-sectional shape of the first weft yarns of the first and second weft systems is substantially rectilinear;

the cross-sectional shape of the second weft yarns of the first and second weft systems is substantially rounded;

the first and second weft yarns of the first weft system alternate across a width of the fabric;

the first and second weft yarns of the second weft system alternate across the width of the fabric;

at least some of the first weft yarns of the first weft system are substantially vertically stacked with at least some of the second weft yarns of the second weft system;

at least some of the second weft yarns of the first weft system, are substantially vertically stacked with at least some of the first weft yarns of the second weft system; and a plurality of channels extend through the fabric between the first and second weft systems of weft yarns.

21. The fabric of claim 20, wherein water is capable of flowing through the channels of the fabric at a rate between five to seventy-five gallons per square foot per minute.

22. The fabric of claim 20, wherein the fabric prevents at least approximately 99% of light from passing through the fabric.

23. A method for making a fabric, the method comprising:

a. providing a first weft system of weft yarns, wherein the first weft system comprises a plurality of first weft yarns and a plurality of second weft yarns, each of the first and second weft yarns having a cross-sectional shape, wherein the cross-sectional shape of the first weft yarns is different from the cross-sectional shape of the second weft yarns;

b. providing a second weft system of weft yarns; and c. weaving the first and second weft systems of weft yarns together such that at least some of the weft yarns of the first weft system are substantially vertically stacked with weft yarns of the second weft system, and the cross-sectional shapes of the respectively stacked weft yarns of the first and second weft systems are different from one another.

24. The method of claim 23, wherein providing a first weft system of weft yarns comprises alternately positioning the first weft yarns and second weft yarns of the first weft system across a width of the fabric.

25. The method of claim 23, wherein providing the second weft system of weft yarns comprises providing a plurality of first weft yarns and a plurality of second weft yarns, each of the first and second weft yarns having a cross-sectional shape, wherein the cross-sectional shape of the first weft yarns of the second weft system is different from the cross-sectional shape of the second weft yarns of the second weft system.

26. The method of claim 25, wherein providing a second weft system of weft yarns comprises alternately positioning the first weft yarns and second weft yarns of the second weft system across a width of the fabric.

27. The method of claim 25, wherein weaving the first and second weft systems of weft yarns together comprises weaving at least some of the first weft yarns of the first weft system adjacent to at least some of the second weft yarns of the second weft system, wherein the cross-sectional shape of the first weft yarns of the first weft system is different from the cross-sectional shape of the second weft yarns of the second weft system.

28. The method of claim 25, wherein weaving the first and second weft systems of weft yarns together comprises weaving at least some of the second weft yarns of the first weft system adjacent to at least some of the first weft yarns of the second weft system, wherein the cross-sectional shape of the second weft yarns of the first weft system is different from the cross-sectional shape of the first weft yarns of the second weft system.

29. The method of claim 23, further comprising subjecting the fabric to heat and pressure.

30. The method of claim 23, wherein:

(i) providing a first weft system of weft yarns comprises alternately positioning the first weft yarns and second weft yarns of the first weft system across a width of the fabric;

(ii) providing the second weft system of weft yarns comprises:

(a) providing a plurality of first weft yarns and a plurality of second weft yarns, each of the first and second weft yarns of the second weft system having a cross-sectional shape, wherein the cross-sectional shape of the first weft yarns of the second weft system is different from the cross-sectional shape of the second weft yarns of the second weft system; and (b) alternately positioning the first weft yarns and second weft yarns of the second weft system across the width of the fabric; and (iii) weaving the first and second weft systems of weft yarns together comprises:

(a) weaving at least some of the first weft yarns of the first weft system adjacent to at least some of the second weft yarns of the second weft system; and (b) weaving at least some of the second weft yarns of the first weft system adjacent to at least some of the first weft yarns of the second weft system.

31. The method of claim 23, further comprising manufacturing a pool cover with the fabric.

32. The method of claim 23, wherein weaving the first and second weft systems of weft yarns together further comprises weaving the first and second weft systems together with a warp system of warp yarns.

33. A fabric comprising:

a first weft system of weft yarns woven to a second weft system of weft yarns, at least a portion of the first weft system comprising a plurality of first weft yarns and a plurality of second weft yarns, the first weft yarns having a cross-sectional shape different from that of the second weft yarns, at least some of the weft yarns of the first weft system being substantially vertically stacked with weft yarns of the second weft system that have a cross-sectional shape sufficient to form an open-channel between the first and second weft systems.

34. A fabric comprising:

a first warp system of warp yarns woven to a second warp system of warp yarns, wherein at least a portion of the first warp system comprises a plurality of first warp yarns and a plurality of second warp yarns, each of the first and second warp yarns having a cross-sectional shape, wherein the cross-sectional shape of the first warp yarns of the first weft system is different from the cross-sectional shape of the second warp yarns of the first warp system, at least some of the warp yarns of the first warp system being substantially vertically stacked with warp yarns of the second warp system, and the cross-sectional shapes of the respectively stacked warp yarns of the first and second warp systems being different from one another.

35. A fabric comprising:

a first warp system of warp yarns woven to a second warp system of warp yarns, at least a portion of the first warp system comprising a plurality of first warp yarns and a plurality of second warp yarns, the first warp yarns having a cross-sectional shape different from that of the second warp yarns, at least some of the warp yarns of the first warp system being substantially vertically stacked with warp yarns of the second warp system that have a cross-sectional shape sufficient to form an open-channel between the first and second warp systems.

* * * * *